US008538301B2

(12) United States Patent
Nakaue

(10) Patent No.: US 8,538,301 B2
(45) Date of Patent: Sep. 17, 2013

(54) DEVELOPING DEVICE AND IMAGE FORMING APPARATUS WITH SOFT BLOCKING DISSOLVING FEATURES

(75) Inventor: Takahisa Nakaue, Osaka (JP)

(73) Assignee: Kyocera Mita Corporation (JP)

( * ) Notice: Subject to any disclaimer, the term of this patent is extended or adjusted under 35 U.S.C. 154(b) by 994 days.

(21) Appl. No.: 12/548,523

(22) Filed: Aug. 27, 2009

(65) Prior Publication Data

US 2010/0054779 A1 Mar. 4, 2010

(30) Foreign Application Priority Data

Aug. 29, 2008 (JP) ..... 2008-222026

(51) Int. Cl.
*G03G 15/08* (2006.01)

(52) U.S. Cl.
USPC ..... 399/255; 399/256; 399/257; 399/258; 399/261

(58) Field of Classification Search
USPC ..... 399/254–257, 261
See application file for complete search history.

(56) References Cited

U.S. PATENT DOCUMENTS

| | | | | |
|---|---|---|---|---|
| 3,764,208 | A * | 10/1973 | Takahashi et al. | 399/257 |
| 3,912,388 | A * | 10/1975 | Takahashi et al. | 399/260 |
| 4,937,625 | A * | 6/1990 | Kato et al. | 399/258 |
| 5,355,199 | A * | 10/1994 | Bray | 399/256 |
| 5,913,098 | A * | 6/1999 | Toyama | 399/257 |
| 5,918,092 | A * | 6/1999 | Hama | 399/227 |
| 7,447,468 | B2 * | 11/2008 | Nishimura et al. | 399/254 |
| 7,519,315 | B2 * | 4/2009 | Tatsumi et al. | 399/254 |
| 7,962,071 | B2 * | 6/2011 | Tsuda et al. | 399/260 |
| 8,131,187 | B2 * | 3/2012 | Uno | 399/257 |
| 8,170,451 | B2 * | 5/2012 | Murauchi et al. | 399/254 |
| 8,233,826 | B2 * | 7/2012 | Saito et al. | 399/252 |
| 8,270,881 | B2 * | 9/2012 | Kim | 399/254 |
| 8,326,184 | B2 * | 12/2012 | Kudo et al. | 399/253 |
| 8,488,992 | B2 * | 7/2013 | Kadota et al. | 399/119 |
| 2007/0223969 | A1 * | 9/2007 | Nishimura et al. | 399/254 |
| 2008/0181670 | A1 * | 7/2008 | Tsuda et al. | 399/234 |
| 2009/0092419 | A1 * | 4/2009 | Iwata et al. | 399/254 |
| 2009/0103952 | A1 * | 4/2009 | Sakamoto et al. | 399/258 |
| 2010/0189455 | A1 * | 7/2010 | Kim | 399/53 |

(Continued)

FOREIGN PATENT DOCUMENTS

| | | |
|---|---|---|
| JP | 2002-148915 | 5/2002 |
| JP | 2004117387 A * | 4/2004 |

OTHER PUBLICATIONS

English machine translation of Japanese document, Tsukamoto et al. (JP 2004117387 A); "Developing Device and Image Forming Apparatus"; published Apr. 15, 2004; by Tsukamoto, Takeo; Shoji, Hisafumi; Koyama, Hajime; Ichikawa, Tomoyuki; Matsuura, Atsuka.*

*Primary Examiner* — David Gray
*Assistant Examiner* — Geoffrey Evans
(74) *Attorney, Agent, or Firm* — Gerald E. Hespos; Michael J. Porco; Matthew T. Hespos

(57) ABSTRACT

A developing device for supplying a developer to an image bearing member is provided with a housing configured to define a passage for movement of the developer and a replenishment path configured to communicate with the passage and supply the developer to the passage; a conveyor configured to move the developer in the passage and the replenishment path; and a switching device configured to switch one moving direction to another moving direction of the developer by the conveyor to selectively move the developer toward the replenishment path.

20 Claims, 4 Drawing Sheets

(56) References Cited

U.S. PATENT DOCUMENTS

2010/0322673 A1* 12/2010 Murauchi et al. ..... 399/254
2010/0322674 A1* 12/2010 Saito et al. ..... 399/254
2011/0123230 A1* 5/2011 Suenami et al. ..... 399/254
2011/0129240 A1* 6/2011 Uno ..... 399/30
2011/0176820 A1* 7/2011 Kadota et al. ..... 399/44
2011/0194863 A1* 8/2011 Matsumoto et al. ..... 399/27
2013/0058670 A1* 3/2013 Nakatake et al. ..... 399/53
2013/0084107 A1* 4/2013 Tamaki et al. ..... 399/258

* cited by examiner

DEVELOPING DEVICE AND IMAGE FORMING APPARATUS WITH SOFT BLOCKING DISSOLVING FEATURES

BACKGROUND OF THE INVENTION

1. Field of the Invention

The present invention relates to a developing device accommodating a developer and an image forming apparatus such as a copier, a printer or a facsimile machine.

2. Description of the Related Art

A developing device performing a developing operation using a two-component developer including toner and carrier consumes the developer and requires replenishment of the developer. The developer to be replenished contains only toner or is toner rich (a state containing more toner than carrier). Thus, toner particles become massed together with relatively weak cohesion to cause soft blocking in a toner replenishment path. The soft blocking may cause incomplete mixing of the developer present in the device with newly supplied developer. Further, supplying the toner with the soft blocking to a developing roller and then to a sheet in a printing process may cause image formation failures such as color unevenness and color streaks.

Japanese Unexamined Patent Publication No. 2002-148915 discloses a developing device with means for preventing soft blocking of a developer to be replenished. This developing device includes a developer conveying member and a toner supplying member. Rotary shafts of the developer conveying member and the toner supplying member are aligned on the same axial line. The objective of an agitator between a developer conveyance region and a toner supply region is to pulverize the massed toner particles and facilitate the mixing of the replenished developer with the developer present in the developing device at a point into which the replenished developer and the developer present in the developing device flows each other. The agitator may, however, cause stagnation of the replenished developer and the developer present in the developing device at their interfluent point, which results in their insufficient mixing.

SUMMARY OF THE INVENTION

An object of the present invention is to provide a developing device and an image forming apparatus capable of more reliably dissolving soft blocking of a replenished developer.

One aspect of the present invention is directed to a developing device, comprising a housing configured to define a passage for movement of the developer; a replenishment path configured to communicate with the passage and supply the developer to the passage; a conveyor configured to move the developer in the passage and the replenishment path; and a switching device configured to switch one moving direction to another moving direction of the developer by the conveyor to selectively move the developer toward the replenishment path.

Another aspect of the present invention is directed to an image forming apparatus, comprising an image bearing member; and a developing device for supplying a developer to the circumferential surface of the image bearing member, wherein the developing device includes: a housing configured to define a passage for movement of the developer; a replenishment path configured to communicate with the passage and supply the developer to the passage; a conveyor configured to move the developer in the passage and the replenishment path; and a switching device configured to switch one moving direction to another moving direction of the developer by the conveyor to selectively move the developer toward the replenishment path.

These and other objects, features and advantages of the present invention will become more apparent upon a reading of the following detailed description with reference to accompanying drawings.

DETAILED DESCRIPTION OF THE PREFERRED EMBODIMENTS (Schematic Construction of a Copier According to One Embodiment of an Image Forming Apparatus)

Hereinafter, one embodiment of the present invention is described in detail with reference to the accompanying drawings. In the following description, a copier is exemplarily illustrated as an image forming apparatus. In the respective drawings, reduction scales of members are appropriately changed to show the respective members in recognizable sizes.

Figure 1:
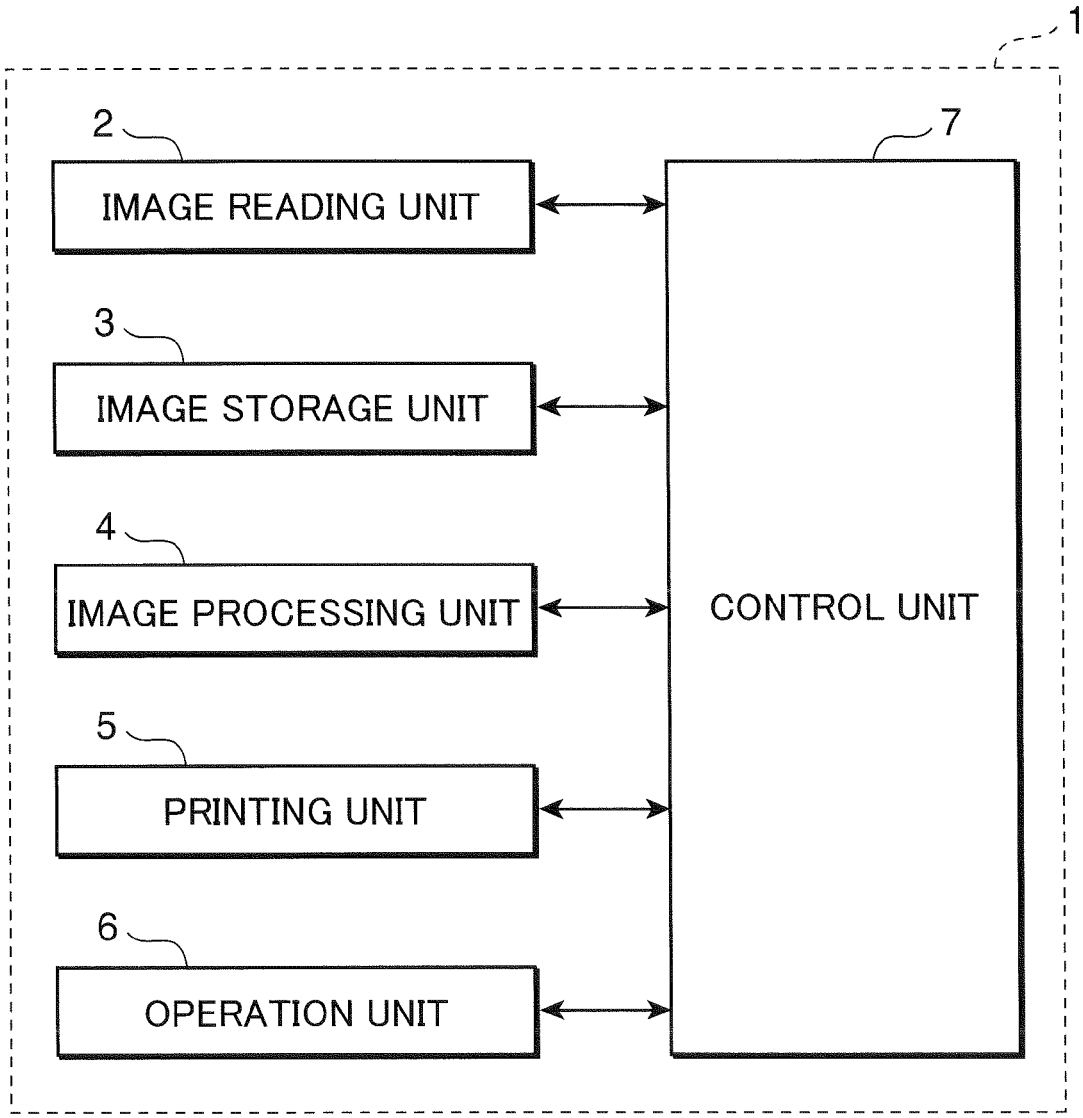
FIG. 1 is a block diagram showing a functional construction of a copier according to one embodiment of the invention.
Figure 2:
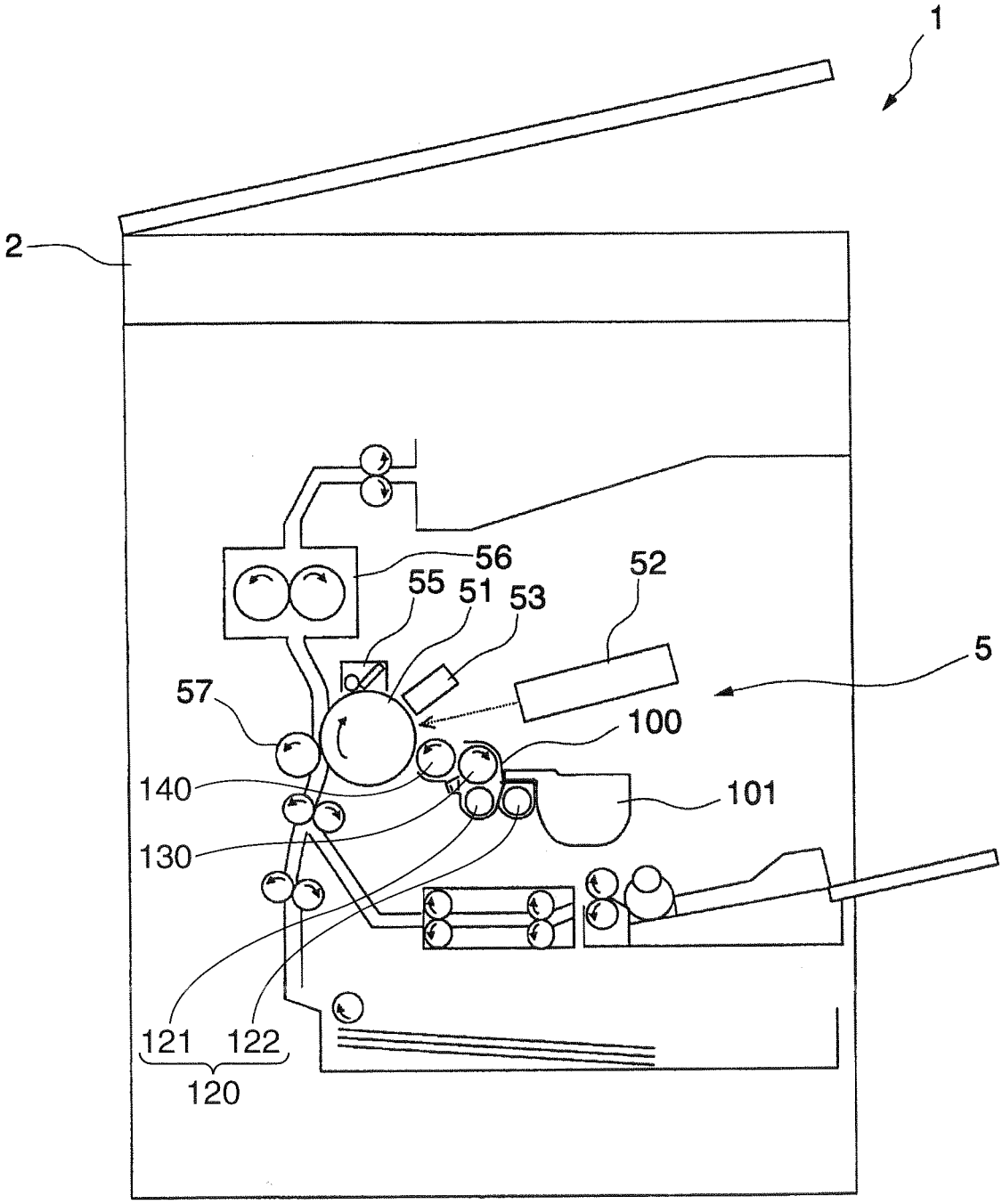
FIG. 2 is a schematic diagram showing a construction of the copier according to the embodiment of the invention.

FIG. 1 is a block diagram showing a functional construction of a copier 1 according to one embodiment of the invention, and FIG. 2 is a schematic diagram showing construction of the copier 1 according to the embodiment of the invention. The copier 1 according to this embodiment is provided with an image reading unit 2, an image storage unit 3, an image processing unit 4, a printing unit 5, an operation unit 6 and a control unit 7 as shown in FIG. 1.

The image reading unit 2 includes, for example, an automatic document feeder such as an ADF (auto document feeder) and a scanner for reading an image of a document. The image reading unit 2 is configured to read an image of a document fed by the automatic document feeder using the scanner and output image data including the shape, color and the like of the document image in accordance with a control command inputted from the control unit 7.

The image storage unit 3 includes an external storage device such as a hard disk and/or a semiconductor memory or the like. The image storage unit 3 is configured to write image data read in the image reading unit 2 as well as to read and output the stored document image data in accordance with a control command inputted from the control unit 7.

The image processing unit 4 is configured to convert the document image data inputted from the image storage unit 3 into image data for the print format and output the converted image data in accordance with a control command inputted from the control unit 7. Optionally, the image processing unit 4 may be configured to convert the document image data into the image data with the print format while applying various image processing to the document image data. For example, if the image reading unit 2 reads a document formed with a color image, document image data inputted from the image storage unit 3 to the image processing unit 4 is RGB image data corresponding to three primary colors of light. The image processing unit 4 may convert such RGB image data, for example, into YMCK image data (image data with standard colors of Y (yellow), M (magenta), C (cyan), K (black)) corresponding to the print format of the printing unit 5 and output the converted image data.

The printing unit 5 is configured to attach toner to a print sheet while conveying the print sheet in accordance with a control command inputted from the control unit 7. Thus, an image is formed on the print sheet based on the image data inputted from the image processing unit 4. As shown in FIG. 2, the printing unit 5 includes a cylindrical photoconductive drum (image bearing member) 51, an exposure device 52, a charger 53, a developing device 100, a cleaning unit 55 and a fixing device 56 and the like. A rotary shaft of the photoconductive drum 51 extends in a width direction of a sheet being conveyed. An electrostatic latent image and a toner image based on the electrostatic latent image are formed on the circumferential surface of the photoconductive drum 51. The charger 53 arranged to face the photoconductive drum 51 is configured to charge the circumferential surface of the photoconductive drum 51. The exposure device 52 arranged above the photoconductive drum 51 scans the circumferential surface of the photoconductive drum 51 with a laser beam emitted in accordance with the image data of the print format. The laser beam scanning the circumferential surface of the photoconductive drum 51 charged by the charger 53 forms an electrostatic latent image based on the image data with the print format on the circumferential surface of the photoconductive drum 51.

The developing device 100 arranged to face the photoconductive drum 51 is configured to supply toner to the circumferential surface of the photoconductive drum 51. Thus, a toner image corresponding to the electrostatic latent image is developed on the circumferential surface of the photoconductive drum 51. The developing device 100 is connected to a toner container 101 from which the toner (also containing carrier) is supplied to the developing device 100. The cleaning unit 55 includes a cleaning roller, a cleaning blade and the like to remove the toner remaining on the photoconductive drum 51. The image corresponding to the electrostatic latent image is transferred to a print sheet while the print sheet passes between the photoconductive drum 51 and a transfer roller 57 arranged to face the photoconductive drum 51, and then the fixing device 56 provided with a pair of rollers including a heating roller and a pressure roller presses and heats the print sheet to fix the toner thereon.

Referring back to FIG. 1, the operation unit 6 provided with an operation panel including a display unit and operation keys is configured to transmit a user's command to the control unit 7. The display unit configured to function as a man-machine interface to make the connection between the user and the copier 1 may include, for example, a touch panel, a liquid crystal display or the like. The operation keys configured to output an operation signal based on the user's operation to the control unit 7 may be hardware keys other than operation buttons displayed on the display unit, such as a power button, number buttons and a print start button.

The control unit 7 is provided with electronic components, electronic circuits including a CPU (Central Processing Unit) and internal memories such as a ROM (Read Only Memory) and a RAM (Random Access Memory), and various input/output interface circuits configured to transfer data to and from the image reading unit 2, the image storage unit 3, the image processing unit 4, the printing unit 5 and the operation unit 6 and the like.

(Construction of the Developing Device)

Figure 3:
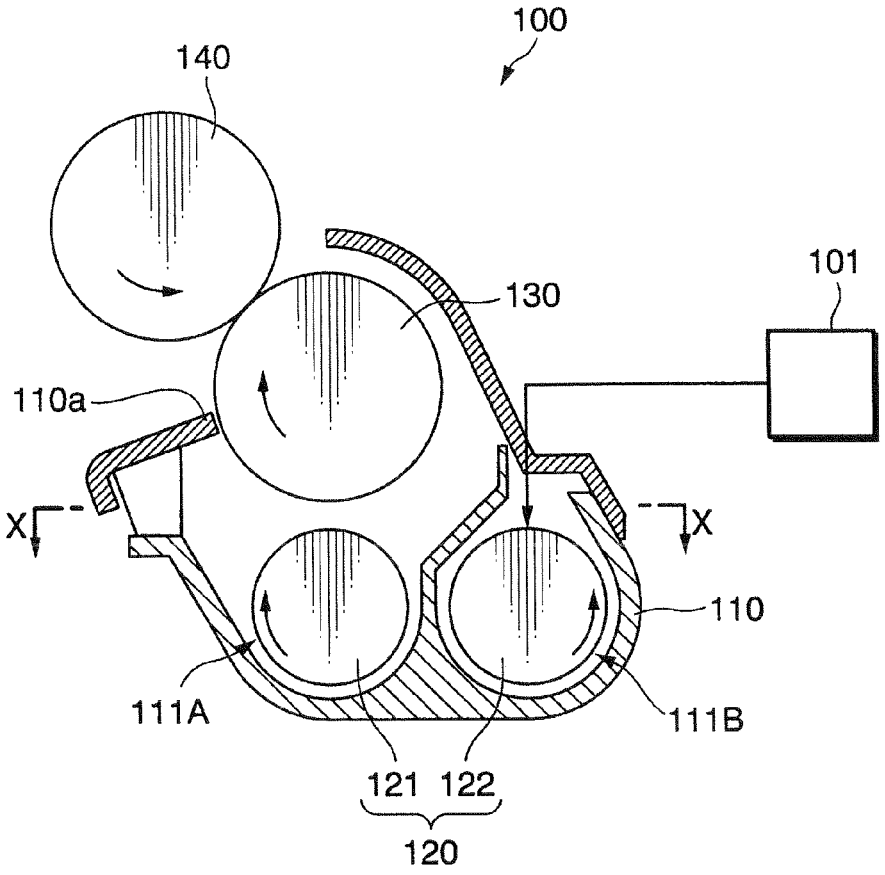
FIG. 3 is an enlarged view of a developing device according to one embodiment of the invention.
Figure 4:
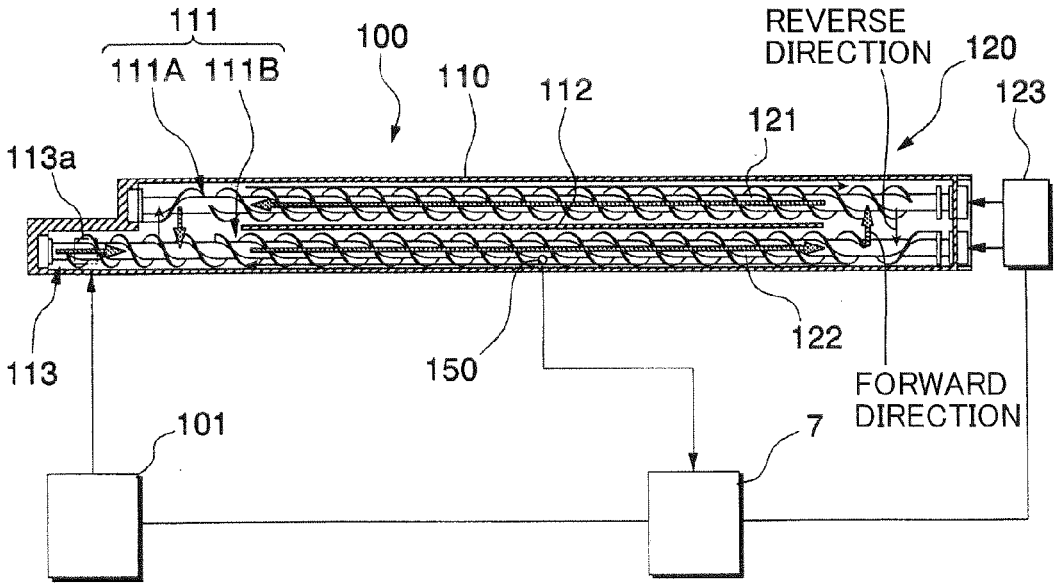
FIG. 4 is a sectional view along X-X of FIG. 3.

FIG. 3 is an enlarged view of the developing device 100 according to one embodiment of the present invention, and FIG. 4 is a section along X-X of FIG. 3. The developing device 100 includes a developer container (housing) 110 containing a two-component developer including toner and carrier, a conveyor 120 including a first screw 121 and a second screw 122 for agitating and mixing the developer contained in the developer container 110, a magnetic roller 130 arranged to face the first screw 121, a developing roller 140 arranged to face the magnetic roller 130, a toner density detection sensor (see FIG. 4) for detecting the densities (mixing ratio) and remaining amounts of the toner and the carrier in the developer container 110, and the control unit 7 (switching device).

As shown in FIG. 4, the developer container 110 includes a circulation path (passage) 111, in which the developer circulates, and a replenishment path 113 communicating with the circulation path 111 to replenish new developer. The circulation path 111 includes a first conveyance path 111A in which the first screw 121 is arranged and a second conveyance path 111*b* in which the second screw 122 is arranged. The first and second conveyance paths 111A, 111B, between which a partition wall 112 is placed, are arranged in parallel. Both ends of the first and second conveyance paths 111A, 111B communicate with each other. The first screw 121 includes a shaft extending along a longitudinal axis of the first conveyance path 111A and a spiral blade (conveyor blade) wound around the shaft. The second screw 122 includes a shaft (switching shaft) extending along a longitudinal axis of the second conveyance path 111B and the replenishment path 113 and a spiral blade (switching conveyor blade) wound around the shaft. The shafts of the first and second screws 121, 122 are coupled via a pair of gears fixed to ends of the both shafts. The first and second screws 121, 122 rotate about the respective shafts.

The replenishment path 113 is formed at one end (left end in FIG. 4) of the second conveyance path 111B and projects with respect to the first conveyance path 111A. The replenishment path 113 is coaxial with the longitudinal axis of the second conveyance path 111B and communicates with the second conveyance path 111B. A replenishment port 113*a* is formed in an upper part of the replenishment path 113. The developer is replenished from the toner container 101 through the replenishment port 113*a*.

The conveyor 120 includes the first screw 121, the second screw 122 and a driving source 123 for rotating the first and second screws 121, 122. The first screw 121 has an entire length substantially equal to that of the first conveyance path 111A and is supported rotatably about a rotational axis extending in a longitudinal direction of the first conveyance path 111A. The second screw 122 extending in the first conveyance path 111B and the replenishment path 113 is supported rotatably about a rotational axis extending in a longitudinal direction (conveying direction) of the second conveyance path 111B and the replenishment path 113. The driving source 123 may includes a motor, for example. The control unit 7 is configured to transmit signals for rotating the driving source 123 in a forward direction and in a reverse direction. The first and second screws 121, 122 are coupled via the gears and rotated in opposite directions each other when the driving source 123 is rotated in the forward or reverse direction in accordance with a control command inputted from the control unit 7, whereby the developer is agitated while being circulated in the circulation path 111. In the following description, a conveying direction of the conveyor 120 to convey the developer in a counterclockwise direction in FIG. 4 is called as a forward direction and the one to convey the developer in a clockwise direction is called as a reverse direction.

As shown in FIG. 3, the magnetic roller 130 is disposed above the first screw 121. By a magnetic action, a developer layer (magnetic brush) made up of the toner and carrier is formed on the circumferential surface of the magnetic roller 130. A doctor blade 110*a* provided in the developing device 110 restricts the thickness of the developer layer to a constant thickness.

The developing roller 140 between the magnetic roller 130 and the photoconductive drum 51 is configured to receive the toner from the developer layer formed on the magnetic roller 130 and supply the received toner to the photoconductive drum 51.

The toner density detection sensor 150, as shown in FIG. 4, electrically connected to the control unit 7, is configured to detect the densities and remaining amounts of the toner and the carrier in the developer container 110 and output detection results to the control unit 7.

(Operation of the Developing Device)

1. Developing Process

Figure 5:
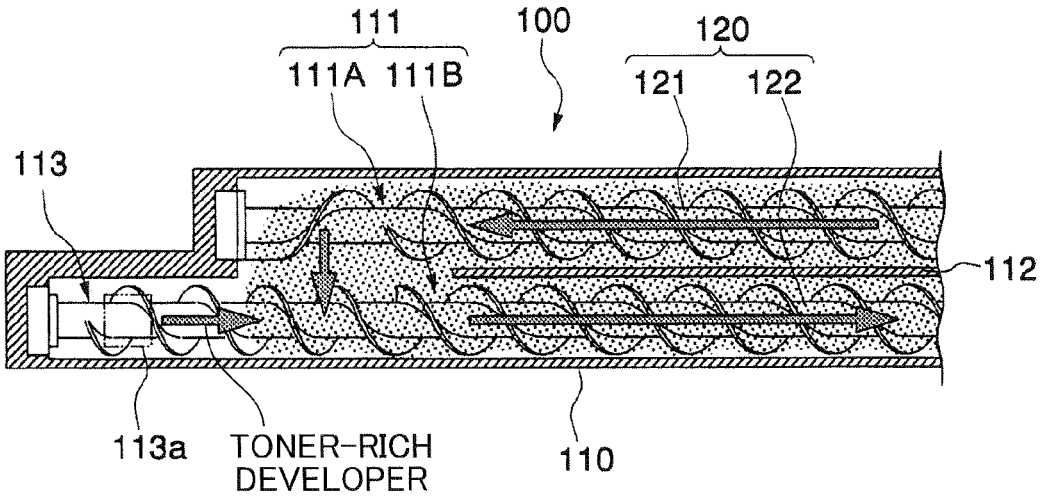
FIG. 5 is a diagram showing the flow of a developer conveyed during a developing operation of the developing device according to the embodiment of the invention.
Figure 6:
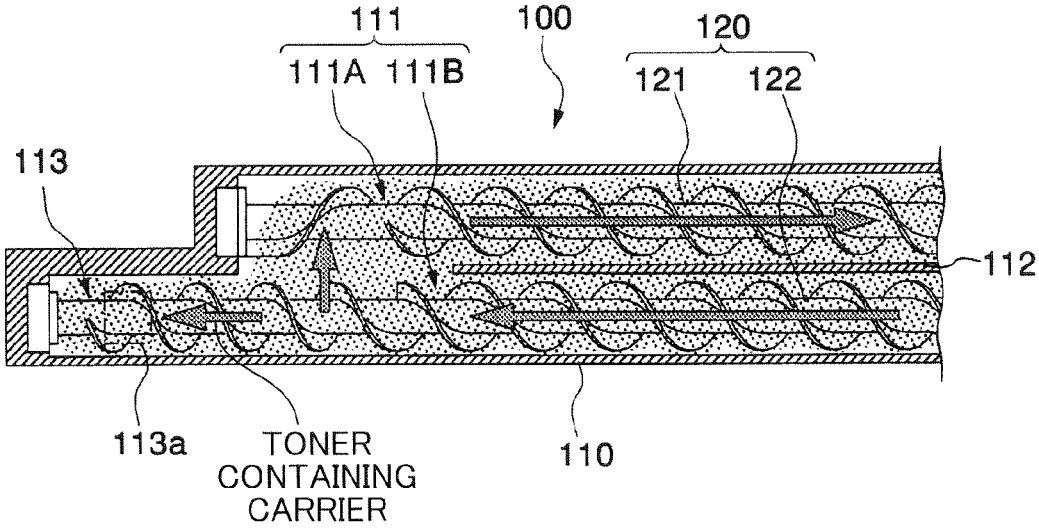
FIG. 6 is a diagram showing the flow of the developer after the completion of the developing operation of the developing device according to the embodiment of the invention.

FIG. 5 shows the flow of the developer conveyed during a developing operation of the developing device 100 according to the embodiment of the present invention, and FIG. 6 shows the flow of the developer after the completion of the developing operation of the developing device 100 according to the embodiment of the present invention. As shown in FIG. 5, during a printing operation of the copier 1, the developing device 100 circulates the developer in the forward direction to supply the toner to the photoconductive drum 51. The driving source 123 after receiving a control command from the control unit 7 (see FIG. 4) rotates the first and second screws 121, 122 to circulate the developer. By this circulation, a part of the developer after arrival at the first conveyance path 111A is magnetically attracted to the circumferential surface of the magnetic roller 130 to form a developer layer. The doctor blade 110*a* restricts the thickness of the developer layer, so that a desired amount of the toner is supplied to the developing roller 140. The developing roller 140 supplies the toner received from the magnetic roller 130 to the photoconductive drum 51 facing the developing roller 140. In this way, a toner image corresponding to an electrostatic latent image is developed on the photoconductive drum 51.

The above developing process decreases the developer in the developer container 110. The toner density detection sensor 150 detects the densities and remaining amounts of the toner and carrier in the developer container 110 at every specified sampling time and outputs the detection results to the control unit 7. The control unit 7 outputs a control command to the toner container 101 to replenish the developer container 110 with the developer based on the inputted detection results. The toner container 101 supplies new toner to the replenishment path 113 through the replenishment port 113*a* in accordance with the inputted control command. During the developing process, the conveyor 120 conveys the developer supplied to the replenishment path 113 in the forward direction from the replenishment path 113 to the circulation path 111.

The toner-rich developer supplied to the replenishment path 113 is joined and mixed with the developer in the circulation path 111 while being agitated by the rotation of the second screw 122. At this time, the toner attaches to the second screw 122 and the side walls of the replenishment path 113 to fill up clearances between the second screw 122 and the side walls of the replenishment path 113 and clearances between screw teeth of the second screw 122. As a result, soft blocking occurs.

2. Switching Process

As shown in FIG. 6, the developing device 100 circulates the developer in the reverse direction after the completion of the printing operation of the copier 1 (after the completion of the developing operation) to dissolve the soft blocking. During a specified period after the completion of the developing operation, the control unit 7 outputs a control signal to switch the conveying direction of the conveyor 120. This control signal is inputted to the driving source 123. The driving source 123 rotates the first and second screws 121, 122 in directions opposite to the rotating directions during the developing operation. By this rotation, the developer in the circulation path 111 is introduced to the replenishment path 113 to dissolve the mass of the replenished developer and produce the developer that is not toner-rich.

The developer in the circulation path 111 contains the toner and carrier mixed at a specified ratio. By switching the conveying direction of the conveyor 120, a specified amount of the toner is introduced to the replenishment path 113. The carrier has larger volume and weight than the toner as already known. As the second screw 122 is rotated, the carrier flows in the replenishment path 113 to pulverize the mass of the toner produced in the replenishment path 113.

By pulverizing the mass of the toner and changing the toner-rich developer into the developer that is not toner-rich as described above, the replenished developer is more easily mixed with the developer in the circulation path 111 when the conveying direction is switched to the forward direction again thereafter. As a result, the occurrence of an image formation failure can be prevented.

The developing device 100 according to this embodiment includes the circulation path 111, in which the developer circulates, and the replenishment path 113 which communicates with the circulation path 111. The new developer is supplied to the replenishment path 113. The developing device 100 also includes the control unit 7 and the conveyor 120 between the replenishment path 113 and the circulation path 111. The control unit 7 switches the above developer conveying direction of the conveyor 120 between the forward direction in which the developer moves from the replenishment path 113 to the circulation path 111 and the reverse direction in which the developer moves from the circulation path 111 to the replenishment path 113. Switching the conveying direction of the conveyor 120 facilitates the introduction of the developer (particularly carrier) in the circulation path 111 to the replenishment path 113. By introducing the developer in the circulation path 111 to the replenishment path 113 where a large amount of toner-rich developer is present, the soft blocking of the replenished new developer is dissolved and the toner-rich developer becomes the developer that is not toner-rich. Accordingly, the soft blocking can be dissolved without providing a conventionally used agitating member, wherefore the developer does not stagnate at a interfluent point of the replenished developer and the developer inside. Further, by omitting the conventionally used agitating member, a production cost of the developing device can be reduced.

Therefore, the developing device 100 according to this embodiment can more reliably dissolve soft blocking caused by the replenished new developer.

In this embodiment, the conveyor 120 includes the second screw 122 passing in the circulation path 111 and the replenishment path 113. The second screw 122 configured to convey the developer is rotated about the axis of rotation extending along the conveying direction of the developer. The conveying direction of the developer is easily switched when the control unit 7 switches the rotating direction of the second screw 122.

In this embodiment, the conveying direction of the developer may be switched after the completion of the developing process for supplying the developer to the photoconductive drum 51. Thus, switching the conveying direction of the developer may not affect the developing operation.

In this embodiment, the developing device 100 capable of dissolving the soft blocking of the replenished developer may be incorporated into the copier 1. This copier 1 may perform a stable printing operation without causing any image formation failure.

The preferred embodiment of the present invention is described above with reference to the drawings, but the present invention is not limited to the above embodiment. Various shapes, combinations and the like of the respective constituent members shown in the above embodiment are mere examples and various changes may be made to meet a design request or the like without departing from the scope of the present invention. For example, although the conveying direction of the developer is switched after the completion of the developing operation in the above embodiment, it may be periodically switched at specified intervals regardless of the developing operation and the completion of the developing operation. Alternatively, the conveying direction of the developer may be switched at a timing corresponding to a developer replenishment timing of the toner container 101 (e.g. timing immediately before the replenishment of the toner container 101). In a certain specific embodiment, the conveying direction of the developer is preferably switched immediately after the completion of an aging process for circulating the developer in the developing device 100 for a specified period.

The principle relating to the above embodiment is applicable to developing devices having structures different from that of the developing device 100 shown in the above embodiment. Although the conveying direction of the developer is switched by reversing the rotating directions of the first and second screws 121, 122 in the above embodiment, it may be switched by reversing the rotating direction of only the second screw 122. In this case, separate driving sources may be provided for the respective first and second screws 121, 122. Although the spiral blades of the first and second screws 121, 122 are inclined in the same direction so as to apply thrust forces to the developer and cause the circulating flow of the developer by different rotating directions between the spiral blades in the above embodiment, it is apparent to a person skilled in the art that the circulating flow of the developer may be also caused by inclining the spiral blades of the first and second screws 121, 122 in different directions and rotating the first and second screws 121, 122 in the same direction.

The above-described developing device and image forming apparatus according to one embodiment of the present invention includes the following technical features.

One aspect of the above-described embodiment is directed to a developing device, comprising a housing configured to define a passage for movement of the developer and a replenishment path configured to communicate with the passage and supply the developer to the passage; a conveyor configured to move the developer in the passage and the replenishment path; and a switching device configured to make the conveyor switch one moving direction to another moving direction of the developer to selectively move the developer toward the replenishment path. The toner-rich developer is introduced into the housing through the replenishment path while the developer is consumed. The conveyer sends the toner-rich developer from the replenishment path to the passage defined by the housing, which results in mass of the toner. The switching device makes the conveyor switch the moving direction of the developer to selectively move the developer toward the replenishment path, so that the mass of the toner is dissolved or pulverized.

The passage may be a circulation path to facilitate mixing old toner and new toner. The housing may includes a partition partly partitioning the passage into a first conveyance path and a second conveyance path to define the circulation path. The replenishment path may be coaxial with a longitudinal axis of the second conveyance path. The developer introduced into the replenishment path is send to the second conveyance path and circulates along the circulation path while the developer is consumed. The switching device may change the circulation direction of the developer so that the mass of the toner is dissolved or pulverized.

The conveyor may include a switching shaft extending along a moving direction of the developer in the passage and the replenishment path, a switching conveyor blade mounted on the switching shaft to apply a thrust force to the developer and a driving source configured to rotate the switching shaft. The switching shaft may be configured to extend along a longitudinal axis of the second conveyance path and the replenishment path. The switching conveyor blade may be a spiral blade wound around the switching shaft. The conveyor may further include a second shaft configured to extend along a longitudinal axis of the first conveyance path. The second shaft maybe connected to the switching shaft via a gear. A conveyor blade may be mounted on the second shaft and configured to apply a thrust force to the developer. Change in a rotational direction of the switching shaft causes change in moving direction of the developer.

The switching device may includes a control unit configured to send a signal for rotating the driving source in a forward direction and a signal for rotating the driving source in a reverse direction to the driving source. Control of a rotational direction of the driving source from the control unit causes change in a moving direction of the developer.

Another aspect of the above-described embodiment is directed to an image forming apparatus for forming an image on a sheet, comprising an image bearing member and the above-described developing device for supplying a developer to the circumferential surface of the image bearing member. The developing device may further include a developing roller arranged to face the image bearing member. The control unit may send a signal for changing a rotational direction of the driving source after a developing process for supplying a specified amount of the developer to the image bearing member. The toner-rich developer is introduced into the housing through the replenishment path during the developing process for supplying a specified amount of the developer to the image bearing member. The conveyer sends the toner-rich developer from the replenishment path to the passage defined by the housing, which results in mass of the toner. The control unit of the switching device may send the signal to change the rotational direction of the drive source after the developing process, so that the mass of the toner is dissolved or pulverized without effect on the developing process.

This application is based on Japanese Patent Application Serial No. 2008-222026 filed in Japan Patent Office on Aug. 29, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A developing device for supplying a developer to an image bearing member and receiving new developer from a container, comprising:

a housing configured to define a passage for movement of the developer, a partition wall disposed in the housing and partitioning the passage into a first conveyance path and a second conveyance path, the second conveyance path having a first end in communication with a first end of the first conveyance path and a second end in communication with a second end of the first conveyance path, the housing further having a replenishment path projecting from the first end of the second conveyance path, the replenishment path being configured to communicate with the passage and supply the developer to the passage;

a conveyor configured to move the developer in the passage and the replenishment path; and a switching device configured to make the conveyor switch one moving direction to another moving direction of the developer to selectively move the developer toward the replenishment path, so that the developer that is moved toward the replenishment path by the conveyor breaks resultant blocking from the new developer.

2. The developing device according to claim 1, wherein the first and second conveyance paths form a circulation path, and the switching device moves the developer in the circulation path into the replenishment path to break resultant blocking from the new developer.

3. The developing device according to claim 2, wherein:

the replenishment path is coaxial with a longitudinal axis of the second conveyance path.

4. The developing device according to claim 3, wherein the conveyor includes:

a switching shaft configured to extend along a longitudinal axis of the second conveyance path and the replenishment path;

a switching conveyor blade mounted on the switching shaft to apply a thrust force to the developer; and a driving source configured to rotate the switching shaft.

5. The developing device according to claim 4, wherein the switching conveyor blade is a spiral blade wound around the shaft.

6. The developing device according to claim 4, wherein the conveyor further includes:

a second shaft configured to extend along a longitudinal axis of the first conveyance path and connected to the switching shaft via a gear; and a conveyor blade mounted on the second shaft and configured to apply a thrust force to the developer.

7. The developing device according to claim 1, wherein the conveyor includes:

a switching shaft extending along a moving direction of the developer in the passage and the replenishment path;

a switching conveyor blade mounted on the switching shaft to apply a thrust force to the developer; and a driving source configured to rotate the switching shaft.

8. The developing device according to claim 7, wherein:

the switching device includes a control unit; and the control unit sends to the driving source a signal for rotating the driving source in a forward direction and a signal for rotating the driving source in a reverse direction.

9. The developing device according to claim 1, wherein the housing is configured so that the resultant blocking happens to a border between the replenishment path and the second conveyance path.

10. An image forming apparatus for forming an image on a sheet, comprising:

an image bearing member;

a developing device for supplying a developer to a circumferential surface of the image bearing member;

a container containing new developer that is supplied to the developing device, wherein the developing device includes:

a housing configured to define a passage for movement of the developer, a partition wall disposed in the housing and partitioning the passage into a first conveyance path and a second conveyance path, the second conveyance path having a first end in communication with a first end of the first conveyance path and a second end in communication with a second end of the first conveyance path, the housing further having a replenishment path projecting from the first end of the second conveyance path, the replenishment path being configured to communicate with the passage and supply the developer to the passage;

a conveyor configured to move the developer in the passage and the replenishment path; and a switching device configured to make the conveyor switch one moving direction to another moving direction of the developer to selectively move the developer toward the replenishment path, so that the developer that is moved toward the replenishment path by the conveyor breaks resultant blocking from the new developer.

11. The image forming apparatus according to claim 10, wherein:

the developing device further includes a developing roller; and the developing roller is arranged to face the image bearing member.

12. The image forming apparatus according to claim 11, wherein:

the developing device further includes a magnetic roller; and the magnetic roller is arranged to face the developing roller.

13. The image forming apparatus according to claim 12, wherein:

the replenishment path is coaxial with a longitudinal axis of the second conveyance path; and the first and second conveyance paths define a circulation path.

14. The image forming apparatus according to claim 13, wherein:

the conveyor includes a first screw configured to extend along an axis of the first conveyance path and a second screw configured to extend along an axis of the replenishment path and the second conveyance path; and the first screw is arranged to face the magnetic roller.

15. The image forming apparatus according to claim 14, wherein the second screw includes:

a switching shaft configured to extend along a longitudinal axis of the second conveyance path and the replenishment path;

a switching conveyor blade mounted on the switching shaft to apply a thrust force to the developer; and a driving source configured to rotate the switching shaft.

16. The image forming apparatus according to claim 15, wherein:

the switching device includes a control unit; and the control unit sends to the driving source a signal for rotating the driving source in a forward direction and a signal for rotating the driving source in a reverse direction.

17. The image forming apparatus according to claim 15, wherein:

the switching device includes a control unit; and the control unit sends a signal for changing a rotational direction of the driving source after a developing process for supplying a specified amount of the developer to the image bearing member.

18. The image forming apparatus according to claim 10, wherein the housing further includes a replenishment port, to which the container is connected, the replenishment port directly facing a part of the conveyor in the replenishment path.

19. The image forming apparatus according to claim 18, wherein there are no feed rollers in the housing between the replenishment port and the conveyor.

20. The image forming apparatus according to claim 18, wherein the part of the conveyor in the replenishment path of the housing is disposed and aligned for feeding the developer adjacent to the replenishment port.

* * * * *